US011798523B2

(12) United States Patent
Lundquist et al.

(10) Patent No.: US 11,798,523 B2
(45) Date of Patent: Oct. 24, 2023

(54) SYSTEMS AND METHODS FOR GENERATING AUDIO CONTENT IN A DIGITAL AUDIO WORKSTATION

(71) Applicant: Soundtrap AB, Stockholm (SE)

(72) Inventors: Jonas Lundquist, Stockholm (SE); Joakim Persson, Stockholm (SE); Nikhil Nair, Stockholm (SE); Jacqueline Sibert, Stockholm (SE)

(73) Assignee: Soundtrap AB, Stockholm (SE)

( * ) Notice: Subject to any disclaimer, the term of this patent is extended or adjusted under 35 U.S.C. 154(b) by 336 days.

(21) Appl. No.: 17/149,373

(22) Filed: Jan. 14, 2021

(65) Prior Publication Data

US 2021/0241730 A1 Aug. 5, 2021

Related U.S. Application Data

(60) Provisional application No. 62/968,837, filed on Jan. 31, 2020.

(51) Int. Cl.
*G10H 1/00* (2006.01)

(52) U.S. Cl.
CPC ..... *G10H 1/0008* (2013.01); *G10H 2210/105* (2013.01); *G10H 2220/126* (2013.01); *G10H 2240/171* (2013.01)

(58) Field of Classification Search
CPC ..... G10H 1/008; G10H 2210/105; G10H 2220/126; G10H 2240/171; G10H 1/0008
USPC ..... 84/609
See application file for complete search history.

(56) References Cited

U.S. PATENT DOCUMENTS 9,230,526 B1 * 1/2016 Cook ..... G10H 1/0033
10,008,190 B1 * 6/2018 Elson ..... G10H 1/0033
10,726,295 B2 * 7/2020 Takata ..... G16H 40/63
(Continued)

FOREIGN PATENT DOCUMENTS

CN 106547797 A * 3/2017 ..... G06F 16/683
CN 106782460 A * 5/2017 ..... G10H 1/0008
(Continued)

OTHER PUBLICATIONS

Logic Pro User Guide, Logic Pro Step Sequencer Overview, Apple Support, Jan. 23, 2020, downloaded from https://support.apple.com/en-in/guide/logicpro/lgcp39acef9/mac, 3 pgs.
(Continued)

*Primary Examiner* — Christina M Schreiber
(74) *Attorney, Agent, or Firm* — ALSTON & BIRD LLP

(57) ABSTRACT

A method includes displaying a graphical user interface (GUI) for a step sequencer in a digital audio workstation. The GUI includes a sequence of user interface elements corresponding to a portion of a roll for an audio composition. Each user interface element in the sequence of user interface elements represents a respective time interval for a note. The sequence of user interface elements. The method includes receiving a user input interacting with a first user interface element. The method includes, in response to the user input: splitting a played note represented by the first user interface element into two or more played notes. The method further includes providing the audio composition for playback by a speaker.

20 Claims, 8 Drawing Sheets

(56) References Cited

U.S. PATENT DOCUMENTS

| | | | | |
|---|---|---|---|---|
| 2005/0262989 | A1* | 12/2005 | Franzblau | G09B 15/023 84/470 R |
| 2013/0025437 | A1* | 1/2013 | Serletic | G10H 1/0025 84/634 |
| 2014/0069262 | A1* | 3/2014 | Cheever | G10H 1/38 84/613 |
| 2015/0228202 | A1* | 8/2015 | Yun | G09B 15/08 84/477 R |
| 2017/0206055 | A1* | 7/2017 | Baker | G06F 3/165 |
| 2017/0358284 | A1* | 12/2017 | Miki | G11B 27/031 |
| 2018/0233119 | A1* | 8/2018 | Patti | H04L 65/80 |
| 2018/0357990 | A1* | 12/2018 | Goren | G09B 15/009 |
| 2019/0096276 | A1* | 3/2019 | Goren | G10H 1/0008 |
| 2019/0103080 | A1* | 4/2019 | Decker | G10H 1/40 |
| 2019/0139437 | A1* | 5/2019 | Goren | G10H 1/38 |
| 2020/0227013 | A1* | 7/2020 | Elson | H04N 7/15 |
| 2021/0151015 | A1* | 5/2021 | Recchia | G10H 1/0016 |
| 2021/0241730 | A1* | 8/2021 | Lundquist | G10H 1/0008 |
| 2022/0122572 | A1* | 4/2022 | Beasley | G10H 1/0008 |
| 2022/0208158 | A1* | 6/2022 | Friedman | G10H 1/34 |

FOREIGN PATENT DOCUMENTS

| | | | | |
|---|---|---|---|---|
| EP | 2099024 | A1 * | 9/2009 | G10H 1/0008 |
| EP | 3706113 | B1 * | 2/2022 | G10H 1/0008 |
| GB | 2209425 | A * | 5/1989 | G10H 1/0025 |
| JP | 5636665 | B2 * | 12/2014 | |

OTHER PUBLICATIONS

Logic Pro User Guide, Split regions in the Logic Pro Tracks area, Apple Support, Nov. 23, 2020, downloaded from https://support.apple.com/en-in/guide/logicpro/lgcpf7c0e886/mac, 3 pgs.

* cited by examiner

400

SYSTEMS AND METHODS FOR GENERATING AUDIO CONTENT IN A DIGITAL AUDIO WORKSTATION

PRIORITY APPLICATION

This application claims priority to U.S. Prov. App. No. 62/968,837, filed Jan. 31, 2020, which is hereby incorporated by reference in its entirety.

TECHNICAL FIELD

The disclosed embodiments relate generally to generating audio content in digital audio workstation (DAW), and more particularly, to splitting and merging notes in a step sequencer.

BACKGROUND

A digital audio workstation (DAW) is an electronic device or application software used for recording, editing and producing audio files. DAWs come in a wide variety of configurations from a single software program on a laptop, to an integrated stand-alone unit, all the way to a highly complex configuration of numerous components controlled by a central computer. Regardless of configuration, modern DAWs generally have a central interface that allows the user to alter and mix multiple recordings and tracks into a final produced piece.

DAWs are used for the production and recording of music, songs, speech, radio, television, soundtracks, podcasts, sound effects and nearly any other situation where complex recorded audio is needed. MIDI, which stands for "Musical Instrument Digital Interface" is a common data protocol used for storing and manipulating audio data using a DAW.

Conventional DAWs offer a piano roll graphical user interface (GUI). The term "piano roll" is used to refer to a graphical display of, and platform for editing, MIDI note data. Through the piano roll GUI existing notes (e.g., notes recorded on a physical instrument or an external device, such as a keyboard) can be modified and new notes can be created and inserted into the audio composition. One problem with convention piano roll GUIs is that it is difficult to split or merge notes or otherwise adjusts note characteristics (such as length, velocity, the timing). For example, to split notes, a user may need to drag and/or copy-and-paste the same notes multiple times, which is time-consuming and frustrating for the user.

SUMMARY

There is a need for improved systems and methods of adding and modifying notes in a GUI for a DAW.

Some embodiments described herein relate to a flexible grid-based note sequencer GUI (referred to as a step sequencer) that is part of a DAW. The step sequencer is used manipulate notes in a musical composition. In some embodiments, the step sequencer displays toggle-able cells in a grid (e.g., cells can be toggled between representing a played note and representing a rest). Moreover, in accordance with some embodiments, the step sequencers described herein allow the user to split or merge notes (e.g., split or merge cells representing played notes) with simple user inputs (e.g., such as a tap or press and hold, in examples in which the step sequencer is displayed on a touch sensitive surface, or by right clicking and selecting "split note" from a resulting menu). In various embodiments, the user can also modifying the timing, offset, and velocity of notes within the step sequencer. In some embodiments, the step sequencer is "hard-wired" to the audio composition, such that changes made in the step sequencer are immediately reflected in the audio composition without additional user input.

To that end, in accordance with some embodiments, a method is performed at an electronic device. Method includes displaying a graphical user interface for a step sequencer in a digital audio workstation. The graphical user interface for the step sequencer includes a sequence of user interface elements. The sequence of user interface elements corresponds to a portion of a roll for an audio composition. Each user interface element in the sequence of user interface elements represents a respective time interval for a note. The sequence of user interface elements includes a first plurality of user interface elements representing played notes for the corresponding respective time interval and a second plurality of user interface elements representing rests for the corresponding respective time interval. The method further includes receiving a user input interacting with a first user interface element of the first plurality of user interface elements. The method further includes, in response to the user input interacting with the first user interface element of the first plurality of user interface elements: splitting a played note represented by the first user interface element into two or more played notes and replacing display of the first user interface element with two or more additional user interface elements. Each of the two or more additional user interface elements represents a respective one of the two or more played notes. The method further includes providing the audio composition for playback by a speaker.

Further, some embodiments provide an electronic device. The device includes one or more processors and memory storing one or more programs for performing any of the methods described herein.

Further, some embodiments provide a non-transitory computer-readable storage medium storing one or more programs configured for execution by an electronic device. The one or more programs include instructions for performing any of the methods described herein.

Thus, systems are provided with improved methods for generating audio content in a digital audio workstation, particularly in a step sequencer.

BRIEF DESCRIPTION OF THE DRAWINGS

The embodiments disclosed herein are illustrated by way of example, and not by way of limitation, in the figures of the accompanying drawings. Like reference numerals refer to corresponding parts throughout the drawings and specification.

DETAILED DESCRIPTION

Reference will now be made to embodiments, examples of which are illustrated in the accompanying drawings. In the following description, numerous specific details are set forth in order to provide an understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

It will also be understood that, although the terms first, second, etc., are, in some instances, used herein to describe various elements, these elements should not be limited by these terms. These terms are used only to distinguish one element from another. For example, a first user interface element could be termed a second user interface element, and, similarly, a second user interface element could be termed a first user interface element, without departing from the scope of the various described embodiments. The first user interface element and the second user interface element are both user interface elements, but they are not the same user interface element.

The terminology used in the description of the various embodiments described herein is for the purpose of describing particular embodiments only and is not intended to be limiting. As used in the description of the various described embodiments and the appended claims, the singular forms "a," "an," and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting" or "in accordance with a determination that," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]" or "in accordance with a determination that [a stated condition or event] is detected," depending on the context.

Figure 1:
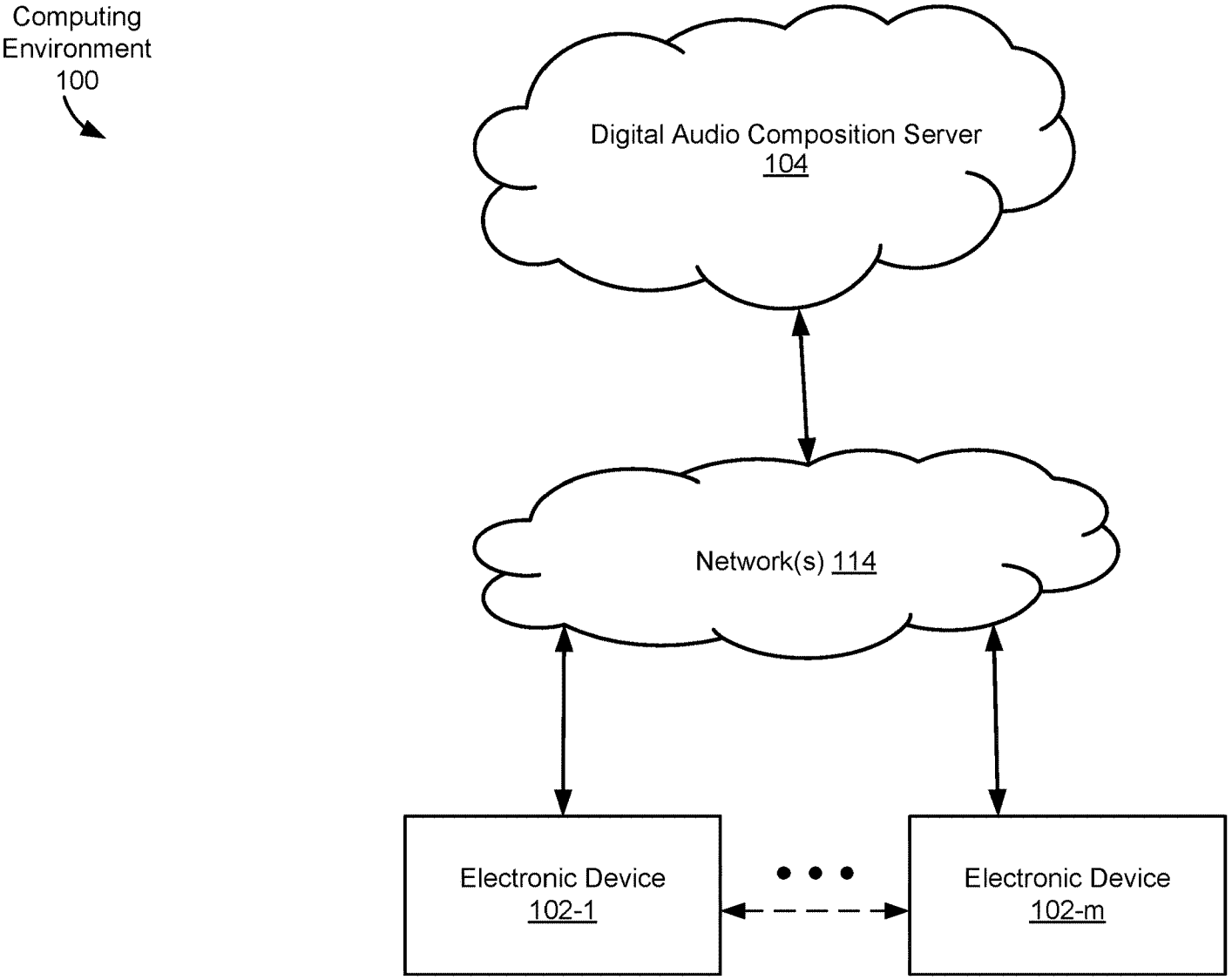
FIG. 1 is a block diagram illustrating a computing environment, in accordance with some embodiments.

FIG. 1 is a block diagram illustrating a computing environment 100, in accordance with some embodiments. The computing environment 100 includes one or more electronic devices 102 (e.g., electronic device 102-1 to electronic device **102-*m*, where m is an integer greater than one) and one or more digital audio composition servers 104**.

The one or more digital audio composition servers 104 are associated with (e.g., at least partially compose) a digital audio composition service (e.g., for collaborative digital audio composition) and the electronic devices 102 are logged into the digital audio composition service. An example of a digital audio composition service is SOUNDTRAP, which provides a collaborative platform on which a plurality of users can modifying a collaborative composition.

One or more networks 114 communicably couple the components of the computing environment 100. In some embodiments, the one or more networks 114 include public communication networks, private communication networks, or a combination of both public and private communication networks. For example, the one or more networks 114 can be any network (or combination of networks) such as the Internet, other wide area networks (WAN), local area networks (LAN), virtual private networks (VPN), metropolitan area networks (MAN), peer-to-peer networks, and/or ad-hoc connections.

In some embodiments, an electronic device 102 is associated with one or more users. In some embodiments, an electronic device 102 is a personal computer, mobile electronic device, wearable computing device, laptop computer, tablet computer, mobile phone, feature phone, smart phone, digital media player, a speaker, television (TV), digital versatile disk (DVD) player, and/or any other electronic device capable of presenting media content (e.g., controlling playback of media items, such as music tracks, videos, etc.). Electronic devices 102 may connect to each other wirelessly and/or through a wired connection (e.g., directly through an interface, such as an HDMI interface). In some embodiments, electronic devices 102-1 and **102-*m* are the same type of device (e.g., electronic device 102-1 and electronic device 102-*m* are both speakers). Alternatively, electronic device 102-1 and electronic device 102-*m* include two or more different types of devices. In some embodiments, electronic device 102-1 (e.g., or electronic device 102-2** (not shown)) includes a plurality (e.g., a group) of electronic devices.

In some embodiments, electronic devices 102-1 and **102-*m* send and receive audio composition information through network(s) 114. For example, electronic devices 102-1 and 102-*m* send requests to add or remove notes, instruments, or effects to a composition, to 104 through network(s) 114**.

In some embodiments, electronic device 102-1 communicates directly with electronic device **102-*m* (e.g., as illustrated by the dotted-line arrow), or any other electronic device 102. As illustrated in FIG. 1, electronic device 102-1 is able to communicate directly (e.g., through a wired connection and/or through a short-range wireless signal, such as those associated with personal-area-network (e.g., Bluetooth/Bluetooth Low Energy (BLE)) communication technologies, radio-frequency-based near-field communication technologies, infrared communication technologies, etc.) with electronic device 102-*m*. In some embodiments, electronic device 102-1 communicates with electronic device 102-*m* through network(s) 114. In some embodiments, electronic device 102-1 uses the direct connection with electronic device 102-*m* to stream content (e.g., data for media items) for playback on the electronic device 102-*m***.

In some embodiments, electronic device 102-1 and/or electronic device **102-*m* include a digital audio workstation application 222 (FIG. 2) that allows a respective user of the respective electronic device to upload (e.g., to digital audio composition server 104), browse, request (e.g., for playback at the electronic device 102**), and/or modify audio compositions (e.g., in the form of MIDI files).

Figure 2:
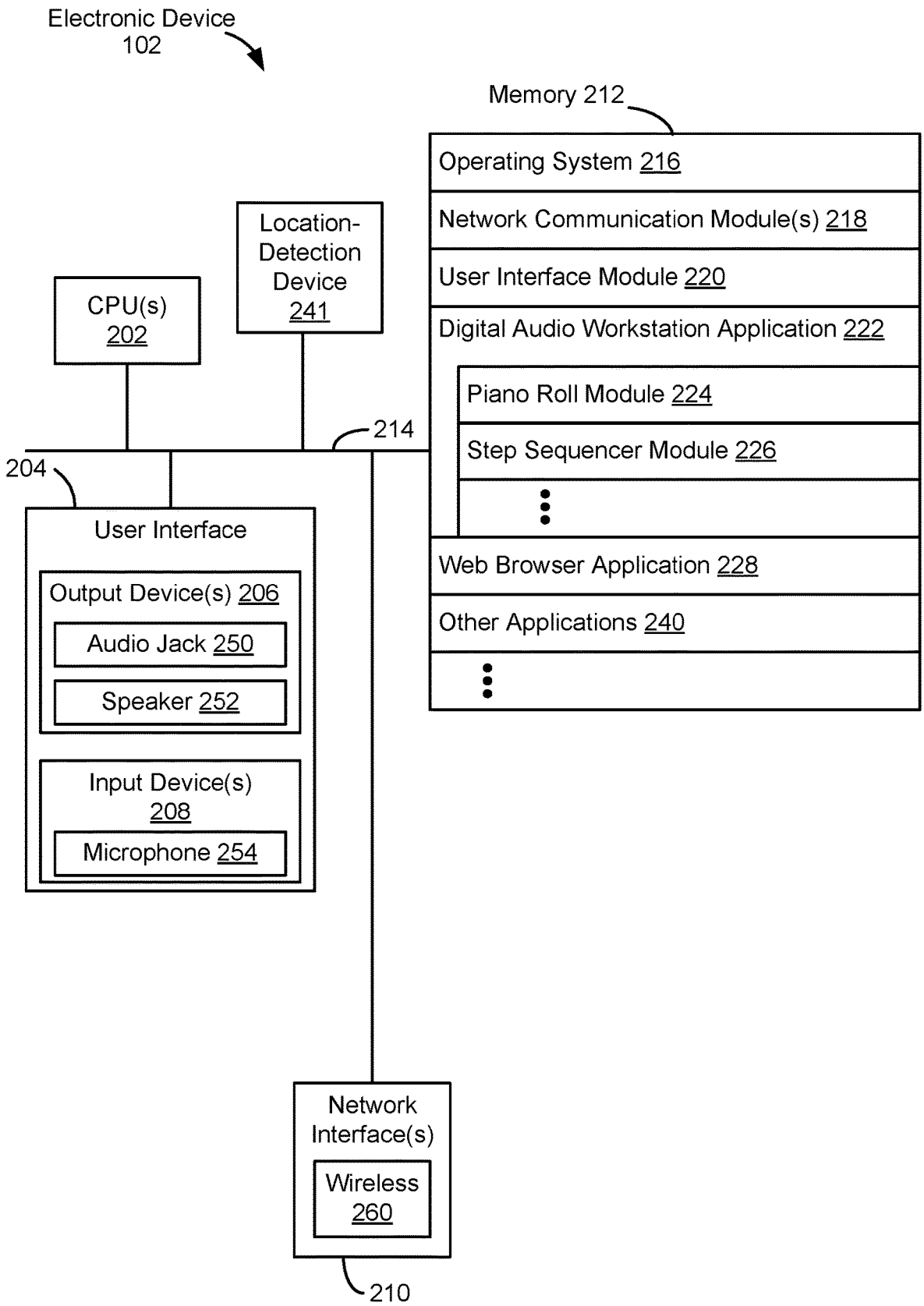
FIG. 2 is a block diagram illustrating a client device, in accordance with some embodiments.

FIG. 2 is a block diagram illustrating an electronic device 102 (e.g., electronic device 102-1 and/or electronic device **102-*m*, FIG. 1), in accordance with some embodiments. The electronic device 102 includes one or more central processing units (CPU(s), i.e., processors or cores) 202, one or more network (or other communications) interfaces 210, memory 212, and one or more communication buses 214 for interconnecting these components. The communication buses 214** optionally include circuitry (sometimes called a chipset) that interconnects and controls communications between system components.

In some embodiments, the electronic device 102 includes a user interface 204, including output device(s) 206 and/or input device(s) 208. In some embodiments, the input devices 208 include a keyboard (e.g., a keyboard with alphanumeric characters), mouse, track pad, a MIDI input device (e.g., a piano-style MIDI controller keyboard) or automated fader board for mixing track volumes. Alternatively, or in addition, in some embodiments, the user interface 204 includes a display device that includes a touch-sensitive surface, in which case the display device is a touch-sensitive display. In electronic devices that have a touch-sensitive display, a physical keyboard is optional (e.g., a soft keyboard may be displayed when keyboard entry is needed). In some embodiments, the output devices (e.g., output device(s) 206) include a speaker 252 (e.g., speakerphone device) and/or an audio jack 250 (or other physical output connection port) for connecting to speakers, earphones, headphones, or other external listening devices. Furthermore, some electronic devices 102 use a microphone and voice recognition device to supplement or replace the keyboard. Optionally, the electronic device 102 includes an audio input device (e.g., a microphone 254) to capture audio (e.g., vocals from a user).

Optionally, the electronic device 102 includes a location-detection device 241, such as a global navigation satellite system (GNSS) (e.g., GPS (global positioning system), GLONASS, Galileo, BeiDou) or other geo-location receiver, and/or location-detection software for determining the location of the electronic device 102 (e.g., module for finding a position of the electronic device 102 using trilateration of measured signal strengths for nearby devices).

In some embodiments, the one or more network interfaces 210 include wireless and/or wired interfaces for receiving data from and/or transmitting data to other electronic devices 102, a digital audio composition server 104, and/or other devices or systems. In some embodiments, data communications are carried out using any of a variety of custom or standard wireless protocols (e.g., NFC, RFID, IEEE 802.15.4, Wi-Fi, ZigBee, 6LoWPAN, Thread, Z-Wave, Bluetooth, ISA100.11a, WirelessHART, MiWi, etc.). Furthermore, in some embodiments, data communications are carried out using any of a variety of custom or standard wired protocols (e.g., USB, Firewire, Ethernet, etc.). For example, the one or more network interfaces 210 include a wireless interface 260 for enabling wireless data communications with other electronic devices 102, and/or or other wireless (e.g., Bluetooth-compatible) devices (e.g., for streaming audio data to the electronic device 102 of an automobile). Furthermore, in some embodiments, the wireless interface 260 (or a different communications interface of the one or more network interfaces 210) enables data communications with other WLAN-compatible devices (e.g., electronic device(s) 102) and/or the digital audio composition server 104 (via the one or more network(s) 114, FIG. 1).

In some embodiments, electronic device 102 includes one or more sensors including, but not limited to, accelerometers, gyroscopes, compasses, magnetometer, light sensors, near field communication transceivers, barometers, humidity sensors, temperature sensors, proximity sensors, range finders, and/or other sensors/devices for sensing and measuring various environmental conditions.

Memory 212 includes high-speed random-access memory, such as DRAM, SRAM, DDR RAM, or other random-access solid-state memory devices; and may include non-volatile memory, such as one or more magnetic disk storage devices, optical disk storage devices, flash memory devices, or other non-volatile solid-state storage devices. Memory 212 may optionally include one or more storage devices remotely located from the CPU(s) 202. Memory 212, or alternately, the non-volatile memory solid-state storage devices within memory 212, includes a non-transitory computer-readable storage medium. In some embodiments, memory 212 or the non-transitory computer-readable storage medium of memory 212 stores the following programs, modules, and data structures, or a subset or superset thereof:

- an operating system 216 that includes procedures for handling various basic system services and for performing hardware-dependent tasks;
- network communication module(s) 218 for connecting the electronic device 102 to other computing devices (e.g., other electronic device(s) 102, and/or digital audio composition server 104) via the one or more network interface(s) 210 (wired or wireless) connected to one or more network(s) 114;
- a user interface module 220 that receives commands and/or inputs from a user via the user interface 204 (e.g., from the input devices 208) and provides outputs for playback and/or display on the user interface 204 (e.g., the output devices 206);
- a digital audio workstation application 222 (e.g., recording, editing and producing audio files such as musical composition). Note that, in some embodiments, the term "digital audio workstation" or "DAW" refers to digital audio workstation application 222 (e.g., a software component). In some embodiments, digital audio workstation application 222 also includes the following modules (or sets of instructions), or a subset or superset thereof:
  - a piano roll module 224 for displaying a graphical user interface for visualizing and editing MIDI note data (e.g., manually entering or modifying the pitch, length and velocity of notes, or modifying the same characteristics of notes output from a keyboard or other device for entering note data);
  - a step sequencer module 226 provides a distinct view of the graphical user interface for editing portions of the audio composition that are also displayed in the piano roll module 224. As a default, notes in the step sequencer portion of the GUI as displayed in a grid and quantized (e.g., snapped to subdivisions on a musical grid (e.g. ⅛th note, 1/16th note etc.)). However, as described herein, notes in the step sequencer can be split, merged, and provided with an offset such that they are no longer strictly quantized; and
  - one or more instrument emulator module(s) 227 for emulating musical instruments (e.g., a piano, guy, percussion set, etc.)
- a web browser application 228 (e.g., Internet Explorer or Edge by Microsoft, Firefox by Mozilla, Safari by Apple, and/or Chrome by Google) for accessing, viewing, and/or interacting with web sites. In some embodiments, rather than digital audio workstation application 222 being a stand-alone application on electronic device 102, the same functionality is provided through a web browser logged into a digital audio composition service;
- other applications 240, such as applications for word processing, calendaring, mapping, weather, stocks, time keeping, virtual digital assistant, presenting, number crunching (spreadsheets), drawing, instant messaging, e-mail, telephony, video conferencing, photo management, video management, a digital music player, a digital video player, 2D gaming, 3D (e.g., virtual reality) gaming, electronic book reader, and/or workout support.

Figure 3:
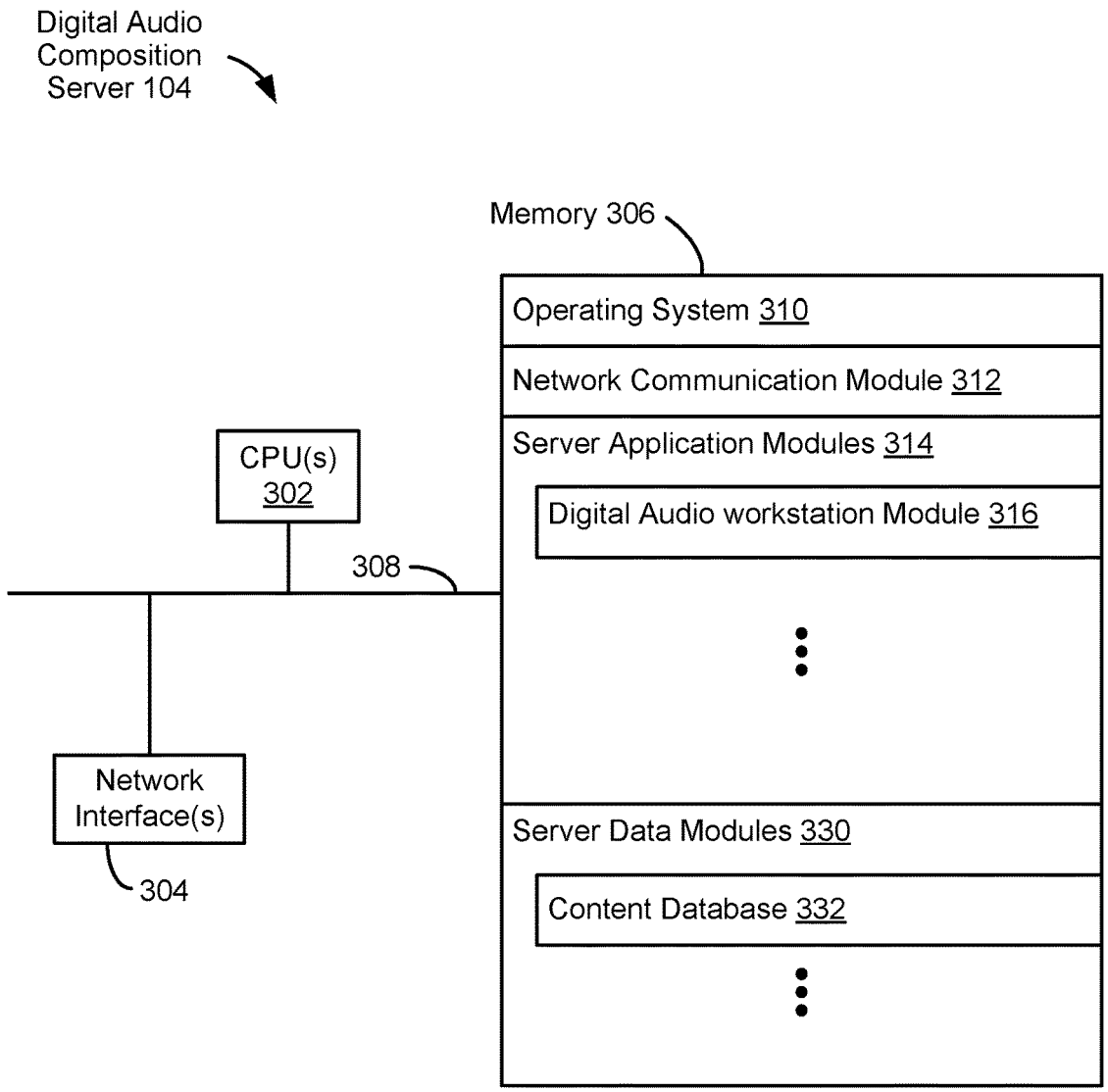
FIG. 3 is a block diagram illustrating a digital audio composition server, in accordance with some embodiments.

FIG. 3 is a block diagram illustrating a digital audio composition server 104, in accordance with some embodiments. The digital audio composition server 104 typically includes one or more central processing units/cores (CPUs) 302, one or more network interfaces 304, memory 306, and one or more communication buses 308 for interconnecting these components.

Memory 306 includes high-speed random access memory, such as DRAM, SRAM, DDR RAM, or other random access solid-state memory devices; and may include non-volatile memory, such as one or more magnetic disk storage devices, optical disk storage devices, flash memory devices, or other non-volatile solid-state storage devices. Memory 306 optionally includes one or more storage devices remotely located from one or more CPUs 302. Memory 306, or, alternatively, the non-volatile solid-state memory device(s) within memory 306, includes a non-transitory computer-readable storage medium. In some embodiments, memory 306, or the non-transitory computer-readable storage medium of memory 306, stores the following programs, modules and data structures, or a subset or superset thereof:

- an operating system 310 that includes procedures for handling various basic system services and for performing hardware-dependent tasks;
- a network communication module 312 that is used for connecting the digital audio composition server 104 to other computing devices via one or more network interfaces 304 (wired or wireless) connected to one or more networks 114;
- one or more server application modules 314 for performing various functions with respect to providing and managing a content service, the server application modules 314 including, but not limited to, one or more of:
  - digital audio workstation module 316 which may share any of the features or functionality of digital audio workstation module 222. In the case of digital audio workstation module 316, these features and functionality are provided to the client device 102 via, e.g., a web browser (web browser application 228);
- one or more server data module(s) 330 for handling the storage of and/or access to media items and/or metadata relating to the audio compositions; in some embodiments, the one or more server data module(s) 330 include a media content database 332 for storing audio compositions. In some embodiments, the audio compositions are stored at least partially using the data structure described below with reference to FIGS. 4A-4B.

In some embodiments, the digital audio composition server 104 includes web or Hypertext Transfer Protocol (HTTP) servers, File Transfer Protocol (FTP) servers, as well as web pages and applications implemented using Common Gateway Interface (CGI) script, PHP Hyper-text Preprocessor (PHP), Active Server Pages (ASP), Hyper Text Markup Language (HTML), Extensible Markup Language (XML), Java, JavaScript, Asynchronous JavaScript and XML (AJAX), XHP, Javelin, Wireless Universal Resource File (WURFL), and the like.

Each of the above identified modules stored in memory 212 and 306 corresponds to a set of instructions for performing a function described herein. The above identified modules or programs (i.e., sets of instructions) need not be implemented as separate software programs, procedures, or modules, and thus various subsets of these modules may be combined or otherwise re-arranged in various embodiments. In some embodiments, memory 212 and 306 optionally store a subset or superset of the respective modules and data structures identified above. Furthermore, memory 212 and 306 optionally store additional modules and data structures not described above. In some embodiments, memory 212 stores one or more of the above identified modules described with regard to memory 306. In some embodiments, memory 306 stores one or more of the above identified modules described with regard to memory 212.

Although FIG. 3 illustrates the digital audio composition server 104 in accordance with some embodiments, FIG. 3 is intended more as a functional description of the various features that may be present in one or more digital audio composition servers than as a structural schematic of the embodiments described herein. In practice, and as recognized by those of ordinary skill in the art, items shown separately could be combined and some items could be separated. For example, some items shown separately in FIG. 3 could be implemented on single servers and single items could be implemented by one or more servers. The actual number of servers used to implement the digital audio composition server 104, and how features are allocated among them, will vary from one implementation to another and, optionally, depends in part on the amount of data traffic that the server system handles during peak usage periods as well as during average usage periods.

Figure 4A:
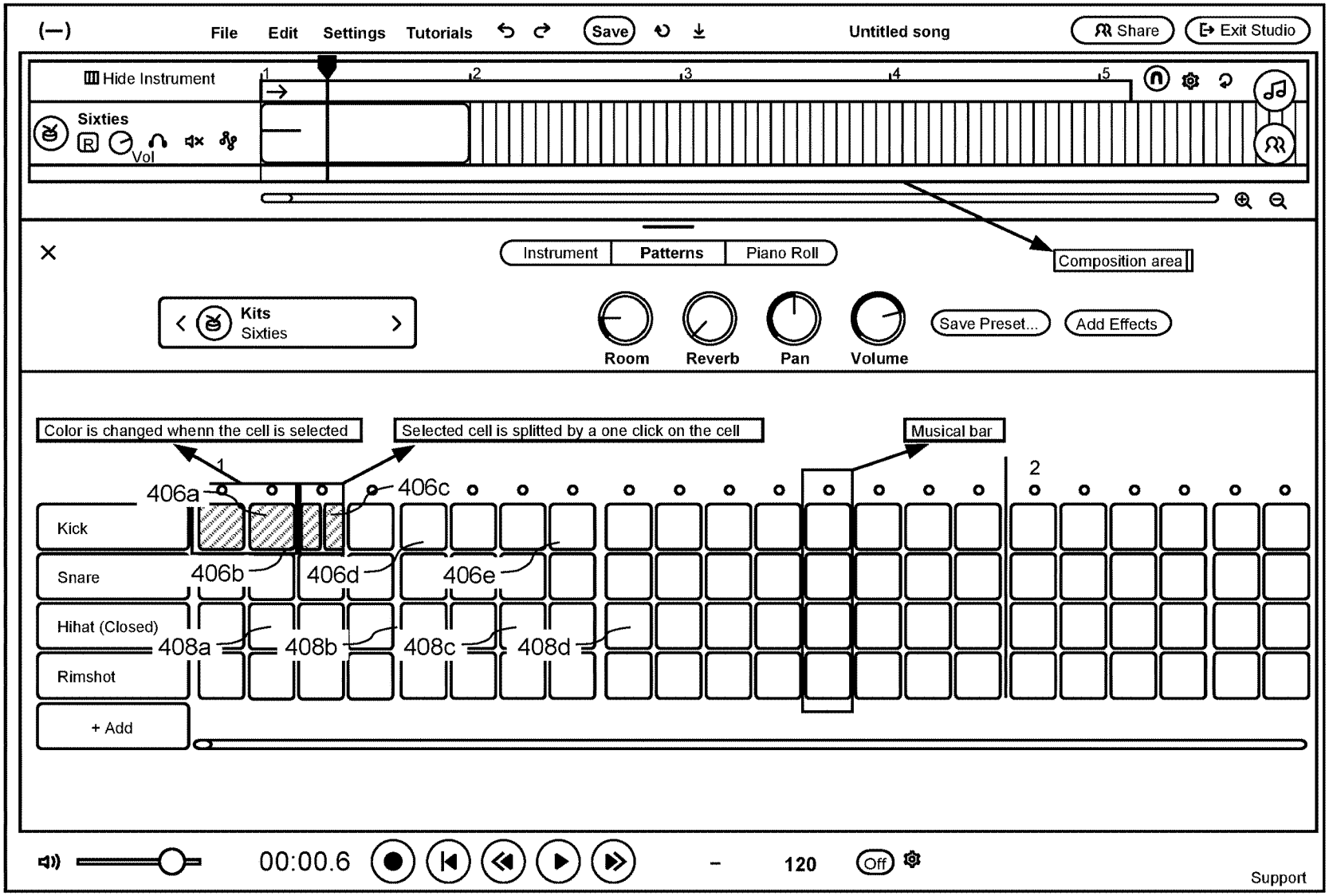
FIGS. 4A-4B illustrate examples of graphical user interfaces for a digital audio workstation that includes a step sequencer, in accordance with some embodiments.
Figure 4B:
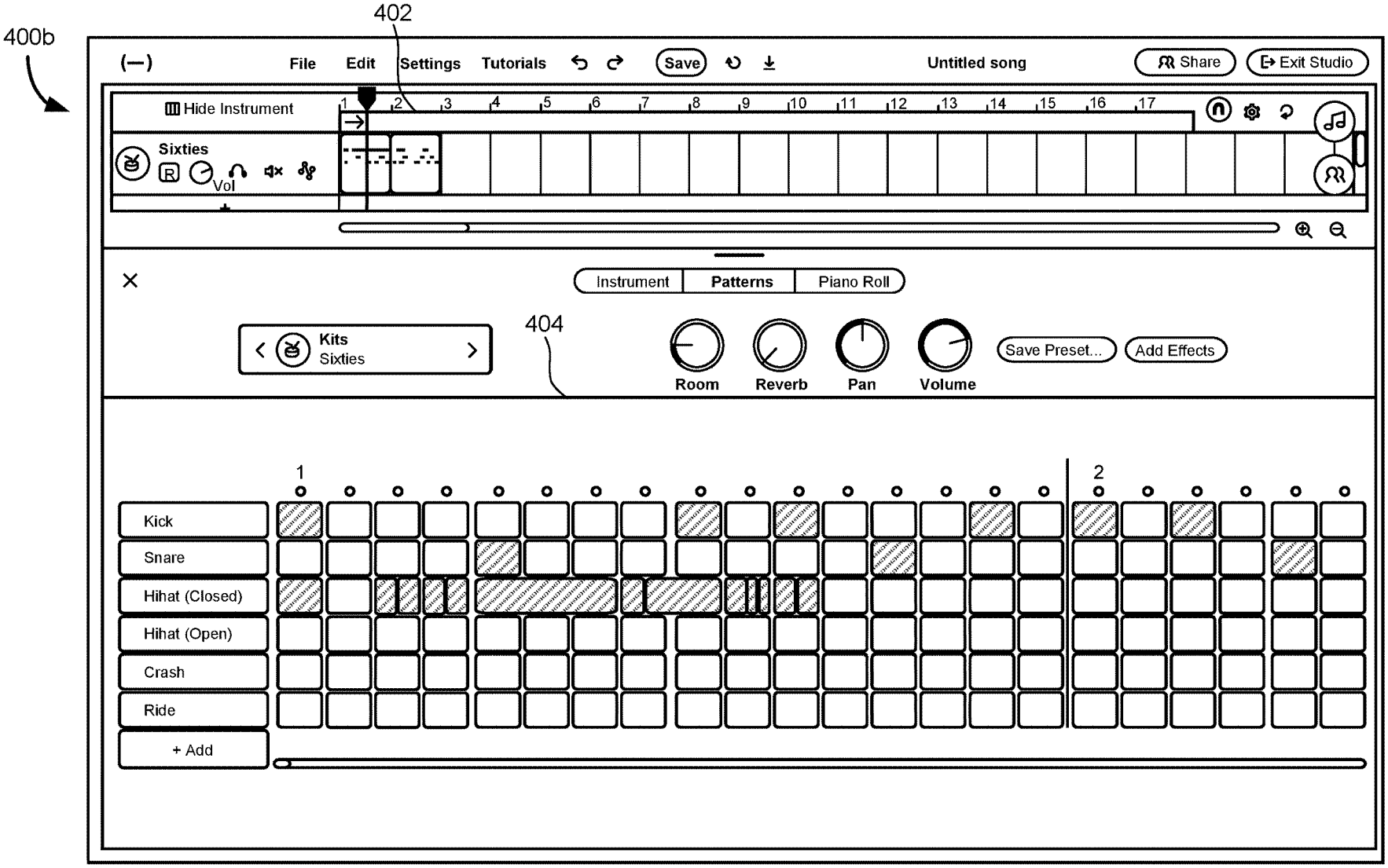

FIGS. 4A-4B illustrate examples of graphical user interfaces 400 for a digital audio workstation (DAW) that includes a step sequencer, in accordance with some embodiments. In particular, FIG. 4A illustrates a graphical user interface 400*a* and FIG. 4B illustrates a graphical user interface 400*b*. Graphical user interface 400*a* and graphical user interface 400*b* are analogous user interfaces, but show different compositions. In some embodiments, graphical user interface 400 is displayed in a web browser and is simultaneously editable by a plurality of users using different client devices (e.g., graphical user interface 400 provides a collaborative composition platform).

Graphical user interfaces 400 include a piano roll 402 (e.g., a graphical user interface for a piano roll, also referred to as a composition area) and a step sequencer 404 (e.g., a graphical user interface for a step sequencer). The graphical user interface for the step sequencer 404 includes a sequence of user interface elements 406 (user interface elements 406*a*-406*d*). Note that for visual clarity, only some of the user interface elements 406 are labeled. The sequence of user interface elements 406 corresponds to a portion of a roll for an audio composition (e.g., the audio composition represented by piano roll 402). Each user interface element in the sequence of user interface elements 406 represents a respective time interval for a note. Note, however, that unlike conventional step sequencers, different user interface elements 406 may represent different time intervals (e.g., the step sequencer is adapted to display notes of different length within a single row). For example, user interface elements 406*a*, 406*d*, and 406*e* may represent an eighth note whereas user interface elements 406*b* and 406*c* represents sixteenth notes.

The sequence of user interface elements includes a first plurality of user interface elements (e.g., which user interface elements 406*a*, 406*b*, 406*c*) representing played notes for the corresponding respective time interval and a second plurality of user interface elements (e.g., which include user interface elements 406*d* and 406*e*) representing rests for the corresponding respective time interval. In some embodiments, a user can interact with user interface elements 406 (e.g., by tapping or clicking on a user interface element 406) to toggle the user interface element between a played note and a rest. In some embodiments, the step sequencer is linked to the piano roll such that changes (e.g., adjustments) made in the step sequencer are reflected in the piano roll without further user interaction (e.g., without further user input). Moreover, the step sequencer is indefinitely scrollable (e.g., scrollable within the limits of computer memory and processing power).

In some circumstances, the sequence of user interface elements 406 is a row in the step sequencer. In some embodiments, the sequence of user interface elements 406 is for editing use of a note made by the single instrument. In some embodiments, the sequence of user interface elements 406 is a first sequence in a plurality of sequences of user interface elements. Each sequence in the plurality of sequences of user interface elements corresponds to a distinct sound made by an instrument. For example, the sequence of user interface elements 406 is for editing sounds made by an emulated kick drum. A second sequence of user interface elements 408 (e.g., user interface elements 408*a*-408*d*) is for editing sounds made by an emulated snare drum. In some embodiments, the step sequencer 404 is for editing sounds made by a single instrument. For example, step sequencer 404 is for editing sounds made by a percussion set (drum set), which is considered herein to be a single instrument.

In some embodiments, through step sequencer 404, a user can split a played note represented by a first user interface element into two or more played notes. As a result, the first user interface element is replaced by two or more corresponding additional user interface elements. User interface element 406*a* is an example of a note having a default time interval and user interface elements 406*b* and 406*c* show the result of splitting note into two notes (e.g., of equal length, half the length of the original note). In some embodiments, the user can split a played note by pressing and holding on the played note (e.g., when GUI 400 is displayed on a touch sensitive surface), or by right clicking and selecting "split note" from a resulting menu). In some embodiments, splitting a note does not result in splitting an adjacent played note (e.g., a horizontally adjacent note corresponding to the same sound made by the same instrument). In some embodiments, as shown in GUI 400*b*, a split notes can be split further. For example, a user can split an eighth note into two sixteenth notes, and then further split one of those two sixteenth notes into two 1/32nd notes. The result is then a sixteenth note, two 1/32nd notes, and whatever additional notes were originally present in the audio composition. The user can toggle these notes individually on and off (e.g., toggle the corresponding user interface element on and off).

In some embodiments, a user can merge notes in a similar manner (e.g., with a two finger touch-and-hold, or by selecting both notes, right clicking, and selecting "merge notes" from a resulting menu).

Further, in some embodiments, split notes are initially quantized (e.g., snapped to subdivisions on the musical grid). For example, the result of splitting a quantized note is two quantized notes. However, GUI 400 allows the user to modify various characteristics of the notes through the step sequencer 40 (e.g., by interacting with the corresponding user interface element), including one or more of: a timing (e.g., offset) of the note, a velocity of the note (e.g., the force with which the note is played); and a length of the note. Further, in some embodiments, the MIDI key of the track can be changed within the step sequencer 404. In some embodiments, a visual characteristic of the user interface element (e.g., transparency and/or color) is modified depending on a non-length characteristic of the note (e.g., the transparency is modified based on the velocity of the note).

Further, in some embodiments, the step sequencer 404 is used to modify audio from pitched instruments (e.g., violins, guitars, oboes, pianos).

To support these features, in some embodiments, a data model is provided. The data model is represented by track configuration objects and their corresponding track objects. A track object includes a cell model, represented by a sequential set of floating point values, or positions, where a value of 1 represents a sixteenth note. Initially, the cell model is populated with a default range of integers, indicating that the default cell model is one of only sixteenth notes. As cells get split or merged as a result of a user interaction or downstream data updates from the region and note data models, the cell model is updated to reflect that, in such a way that a split cell at a given position is replaced by two or more divided position values starting at the replaced cells position. A merged cell at a given position, and the next cell in positional order, is replaced by one cell that covers the total length of the replaced two cells. The track objects are also represented by a set of active cells, indicating what cell is enabled for playing, as well as a length which describes how many cells there are in this track. The track objects are also represented by active cells and their corresponding velocity, indicating at what velocity the note should be played. The track objects' cell model can be represented in un-quantized positions, where there is a possibility to show a quantized visual representation (in the form of cells) in conjunction with a graphical indicator of the un-quantized offset.

The track configuration objects are represented, at least in part, by a pitch (key) and index (vertical columns).

Figure 5A:
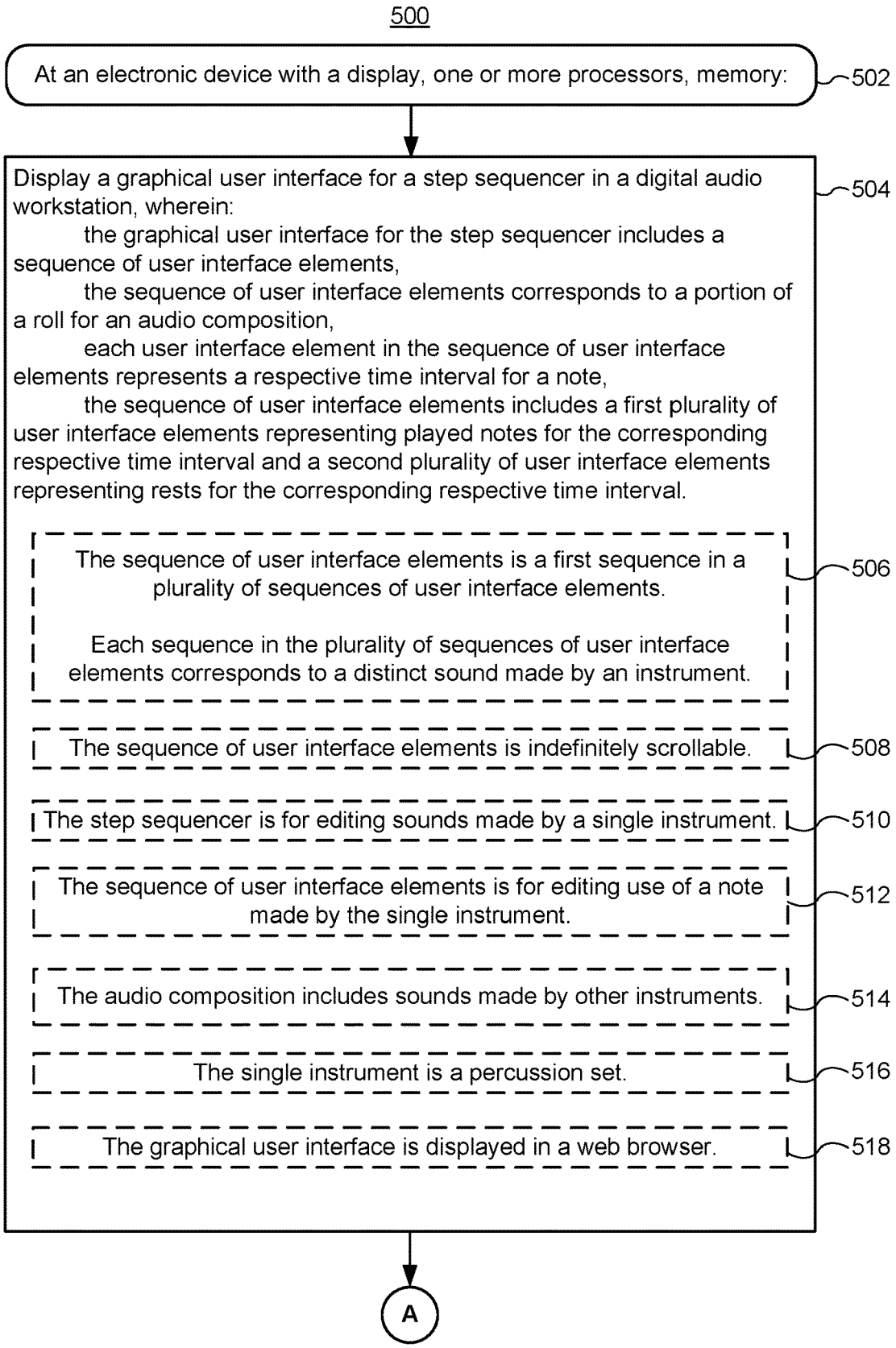
FIGS. 5A-5C are flow diagrams illustrating a method of generating audio content in a digital audio workstation (DAW), in accordance with some embodiments.
Figure 5B:
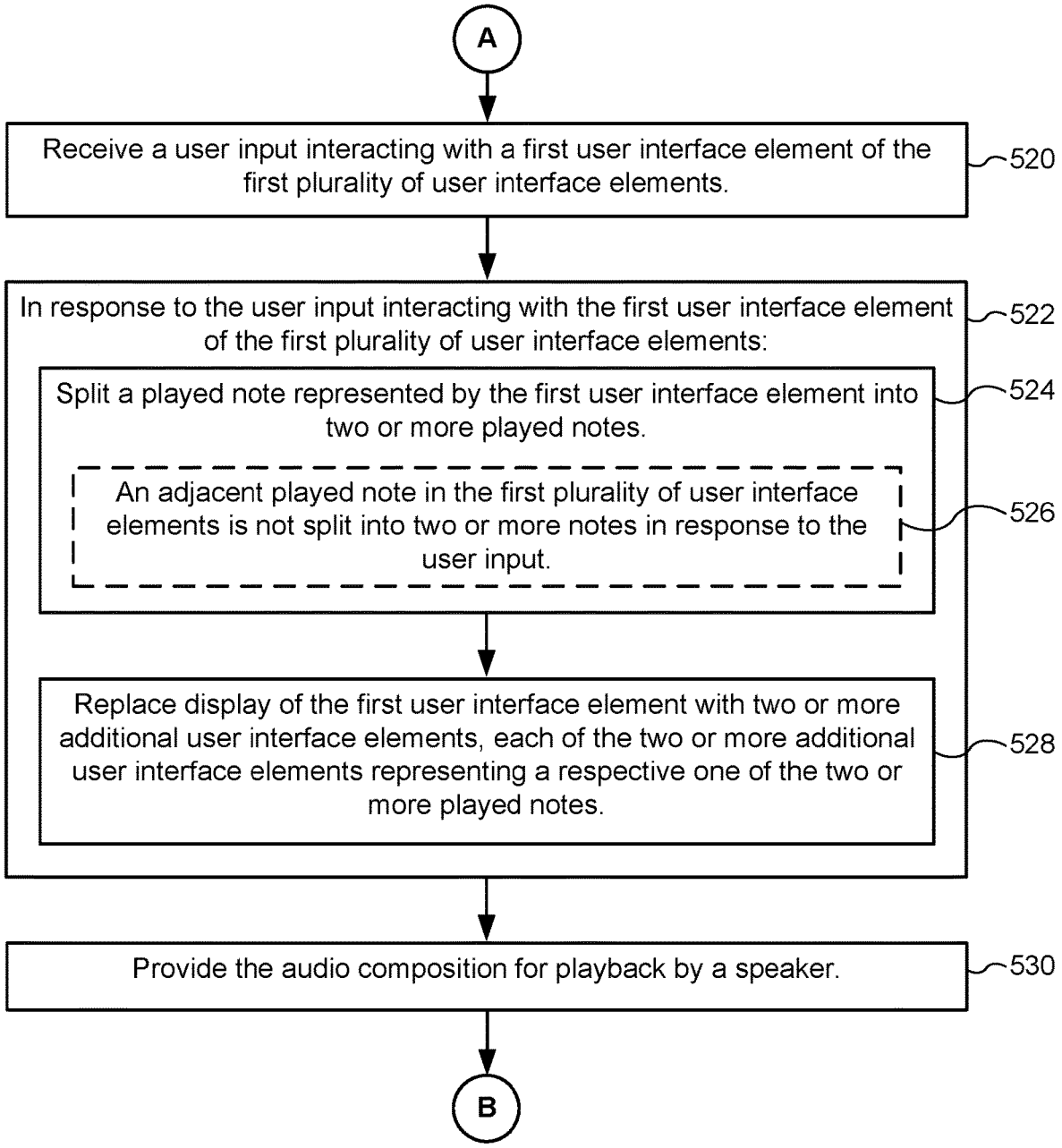
Figure 5C:
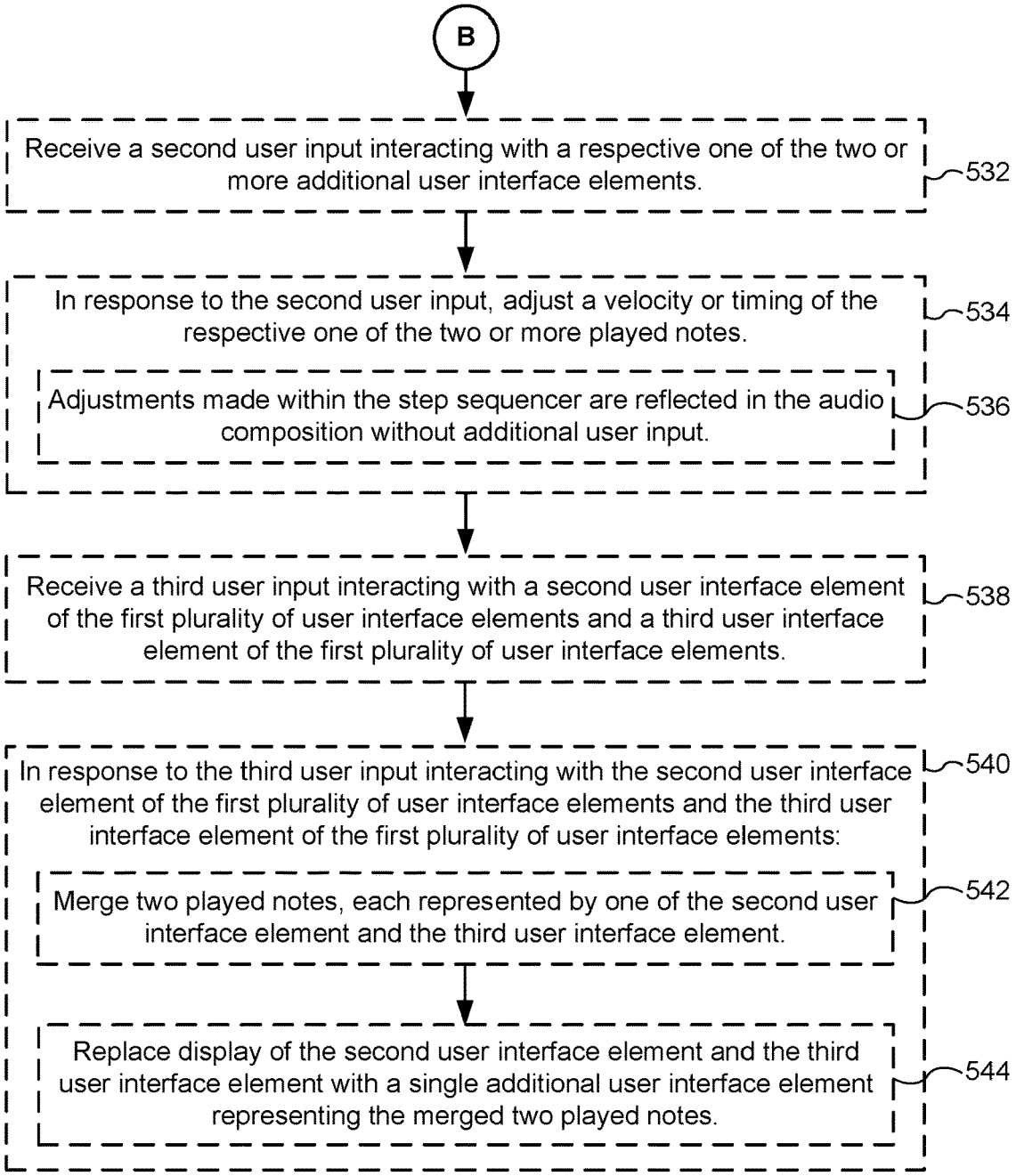

FIGS. 5A-5C are flow diagrams illustrating a method 500 of generating audio content in a digital audio workstation (DAW), in accordance with some embodiments. Method 500 may be performed (502) at an electronic device (e.g., electronic device 102). The electronic device includes a display, one or more processors, and memory storing instructions for execution by the one or more processors. In some embodiments, the method 500 is performed by executing instructions stored in the memory (e.g., memory 212, FIG. 2) of the electronic device. In some embodiments, the method 500 is performed by a combination of a server system (e.g., including digital audio composition server 104) and a client electronic device (e.g., electronic device 102, logged into a service provided by the digital audio composition server 104).

Method 500 includes displaying (504) a graphical user interface for a step sequencer in a digital audio workstation. The graphical user interface for the step sequencer includes a sequence of user interface elements (e.g., cells in a vertical row, such as user interface elements 406, FIG. 4A). The sequence of user interface elements corresponds to a portion of a roll for an audio composition (e.g. the audio composition shown in piano roll 402, FIGS. 4A-4B). Each user interface element in the sequence of user interface elements represents a respective time interval for a note. In some embodiments, the step sequencer is initially displayed with the sequence of elements all having the same corresponding time interval (e.g., corresponding to an eighth note). However, through the manipulations described below, certain user interface elements may be modified to correspond to different time intervals (e.g., split into two sixteenth notes).

The sequence of user interface elements includes a first plurality of user interface elements representing played notes (e.g., active cells) for the corresponding respective time interval and a second plurality of user interface elements representing rests (e.g., inactive cells) for the corresponding respective time interval.

In some embodiments, the sequence of user interface elements is (506) a first sequence in a plurality of sequences of user interface elements and each sequence in the plurality of sequences of user interface elements corresponds to a distinct sound made by an instrument. For example, the sequence of user interface elements is displayed in a horizontal row, where distance along the horizontal roll corresponds to time in the audio composition. A state (e.g. active or inactive) of each user interface element in the sequence of user interface elements determines whether the distinct sound (e.g., a kick drum) is played for the corresponding time interval.

In some embodiments, the sequence of user interface elements is (508) indefinitely scrollable (e.g., within the limits of computer memory and processing).

In some embodiments, the step sequencer is (510) for editing sounds made by a single instrument (e.g., editing distinct sounds made by a single instrument). In some embodiments, the single instrument is (516) a percussion set. In some embodiments, the single instrument is a pitched instrument (e.g., a violin, guitar, piano). In some embodiments, the sequence of user interface elements is (512) for editing use of a note made by the single instrument (e.g., toggling on or off whether that note is played for the respective time interval).

In some embodiments, the audio composition includes (514) sounds made by other instruments. For example, the piano roll will include tracks for a violin, an oboe, and a percussion set, and the step sequencer will allow a user to edit sounds made by a single instrument included in the audio composition (e.g., edit the drum part of the audio composition).

In some embodiments, the graphical user interface is (518) displayed in a web browser.

Method 500 includes receiving (520) a user input interacting with a first user interface element of the first plurality of user interface elements (e.g., a click, a tap, a tap and hold, and/or a click followed by selection of an option afforded by a resulting menu). In response to (522) the user input interacting with the first user interface element of the first plurality of user interface elements, operations 524-528 are performed.

Method 500 include splitting (524) a played note represented by the first user interface element into two or more played notes (e.g. of equal length). For example, user interface elements 406*b*-406*c* (FIG. 4A) correspond to a note that has been split into two notes. In some embodiments, an adjacent played note (e.g., a horizontally adjacent note) in the first plurality of user interface elements is not (526) split into two or more notes in response to the user input. For example, the note represented by user interface element 406*a* (FIG. 4A) has not been split.

Method 500 includes replacing (528) display of the first user interface element with two or more additional user interface elements, each of the two or more additional user interface elements representing a respective one of the two or more played notes. For example, user interface elements 406*b*-406*c* (FIG. 4A) have replaced a single user interface element that was present before the note was split.

Method 500 includes providing (530) the audio composition for playback by a speaker.

In some embodiments, method 500 includes receiving (532) a second user input interacting with a respective one of the two or more additional user interface elements, and in response to the second user input, adjusting (534) a velocity or timing of the respective one of the two or more played notes. In some embodiments, the user interface elements are initially quantized (snapped to a musical grid) and adjusting the timing of the two or more played notes includes providing an un-quantized offset from the musical grid. In some embodiments, one or more characteristics of the note are represented by a visual characteristic of the corresponding user interface element. For example, in some embodiments, notes with a greater velocity are displayed with less transparency (or a different color within a color map). In some embodiments, adjustments made within the step sequencer are reflected (536) in the audio composition without additional user input.

In some embodiments, method 500 includes receiving (538) a third user input interacting with a second user interface element of the first plurality of user interface elements and a third user interface element of the first plurality of user interface elements. In response to (540) the third user input interacting with the second user interface element of the first plurality of user interface elements and the third user interface element of the first plurality of user interface elements, operations 542-544 are performed.

In some embodiments, method 500 includes merging (542) two played notes, each represented by one of the second user interface element and the third user interface element. In some embodiments, method 500 includes replacing (544) display of the second user interface element and the third user interface element with a single additional user interface element representing the merged two played notes. In some embodiments, two notes are merged by selecting the two notes and then clicking on the selection (e.g., while holding down a particular key to indicate that the notes should be merged rather than split).

In some embodiments, the audio composition is simultaneously-editable by a plurality of users. Although FIGS. 5A-5C illustrate a number of logical stages in a particular order, stages which are not order dependent may be reordered and other stages may be combined or broken out. Some reordering or other groupings not specifically mentioned will be apparent to those of ordinary skill in the art, so the ordering and groupings presented herein are not exhaustive. Moreover, it should be recognized that the stages could be implemented in hardware, firmware, software, or any combination thereof.

The foregoing description, for purpose of explanation, has been described with reference to specific embodiments. However, the illustrative discussions above are not intended to be exhaustive or to limit the embodiments to the precise forms disclosed. Many modifications and variations are possible in view of the above teachings. The embodiments were chosen and described in order to best explain the principles and their practical applications, to thereby enable others skilled in the art to best utilize the embodiments and various embodiments with various modifications as are suited to the particular use contemplated.

What is claimed is:

1. A method, comprising;

at an electronic device with a display, one or more processors, memory:

displaying a graphical user interface for a step sequencer in a digital audio workstation, wherein:

the graphical user interface for the step sequencer includes a plurality of user interface elements, the plurality of user interface elements corresponds to a portion of a roll for an audio composition, each user interface element in the plurality of user interface elements represents a respective time interval for a note, the plurality of user interface elements includes a first subset of the plurality of user interface elements representing played notes for the corresponding respective time interval and a second subset of the plurality of user interface elements representing rests for the corresponding respective time interval;

the plurality of user interface elements correspond to toggleable buttons arranged in an array comprising a plurality of rows and columns, each toggleable button being activated or inactivated by a user, wherein a row of the plurality of rows corresponds to a sequence of user interface elements;

receiving a user input interacting with a first user interface element of the first subset of the plurality of user interface elements;

in response to the user input interacting with the first user interface element of the first subset of the plurality of user interface elements:

splitting a played note represented by the first user interface element into two or more played notes;

replacing display of the first user interface element with two or more additional user interface elements, each of the two or more additional user interface elements representing a respective one of the two or more played notes; and providing the audio composition for playback by a speaker.

2. The method of claim 1, wherein an adjacent played note in the first plurality of user interface elements is not split into two or more notes in response to the user input.

3. The method of claim 1, wherein:

the plurality of user interface elements includes a plurality of sequences of user interface elements, wherein a respective row of the plurality of rows corresponds to a respective sequence of the plurality of sequences of user interface elements, each sequence in the plurality of sequences of user interface elements corresponds to a distinct sound made by an instrument.

4. The method of claim 1, further including:

receiving a second user input interacting with a respective one of the two or more additional user interface elements representing a respective one of the two or more played notes, in response to the second user input, adjusting a velocity or timing of the respective one of the two or more played notes.

5. The method of claim 1, wherein the plurality of user interface elements is indefinitely scrollable.

6. The method of claim 1, wherein the step sequencer is for editing sounds made by a single instrument.

7. The method of claim 6, wherein the plurality of user interface elements is for editing use of a note made by the single instrument.

8. The method of claim 6, wherein the audio composition includes sounds made by other instruments.

9. The method of claim 6, wherein the single instrument is a percussion set.

10. The method of claim 1, wherein adjustments made within the step sequencer are reflected in the audio composition without additional user input.

11. The method of claim 1, wherein the graphical user interface is displayed in a web browser.

12. The method of claim 1, wherein the audio composition is simultaneously-editable by a plurality of users.

13. The method of claim 1, further comprising:

receiving a third user input interacting with a second user interface element of the first plurality of user interface elements and a third user interface element of the first plurality of user interface elements;

in response to the third user input interacting with the second user interface element of the first plurality of user interface elements and the third user interface element of the first plurality of user interface elements:

merging two played notes, each represented by one of the second user interface element and the third user interface element; and replacing display of the second user interface element and the third user interface element with a single additional user interface element representing the merged two played notes.

14. An electronic device, comprising:

a display;

one or more processors; and memory storing one or more programs for execution by the one or more processors, the one or more programs including instructions for:

displaying a graphical user interface for a step sequencer in a digital audio workstation, wherein:

the graphical user interface for the step sequencer includes a plurality of user interface elements, the plurality of user interface elements corresponds to a portion of a roll for an audio composition, each user interface element in the plurality of user interface elements represents a respective time interval for a note, the plurality of user interface elements includes a first subset of the plurality of user interface elements representing played notes for the corresponding respective time interval and a second subset of the plurality of user interface elements representing rests for the corresponding respective time interval;

the plurality of user interface elements correspond to toggleable buttons arranged in an array comprising a plurality of rows and columns, each toggleable button being activated or inactivated by a user, wherein a row of the plurality of rows corresponds to a sequence of user interface elements;

receiving a user input interacting with a first user interface element of the first subset of the plurality of user interface elements;

in response to the user input interacting with the first user interface element of the first subset of the plurality of user interface elements:

splitting a played note represented by the first user interface element into two or more played notes;

replacing display of the first user interface element with two or more additional user interface elements, each of the two or more additional user interface elements representing a respective one of the two or more played notes; and providing the audio composition for playback by a speaker.

15. The electronic device of claim 14, wherein an adjacent played note in the first plurality of user interface elements is not split into two or more notes in response to the user input.

16. The electronic device of claim 14, wherein:

the plurality of user interface elements includes a plurality of sequences of user interface elements, wherein a respective row of the plurality of rows corresponds to a respective sequence of the plurality of sequences of user interface elements, each sequence in the plurality of sequences of user interface elements corresponds to a distinct sound made by an instrument.

17. The electronic device of claim 14, the one or more programs further including instructions for:

receiving a second user input interacting with a respective one of the two or more additional user interface elements representing a respective one of the two or more played notes, in response to the second user input, adjusting a velocity or timing of the respective one of the two or more played notes.

18. The electronic device of claim 14, wherein the plurality of user interface elements is indefinitely scrollable.

19. The electronic device of claim 14, wherein the step sequencer is for editing sounds made by a single instrument.

20. A non-transitory computer readable storage medium storing one or more programs for execution by an electronic device with a display and one or more processors, the one or more programs including instructions for:

displaying a graphical user interface for a step sequencer in a digital audio workstation, wherein:

the graphical user interface for the step sequencer includes a plurality of user interface elements, the plurality of user interface elements corresponds to a portion of a roll for an audio composition, each user interface element in the plurality of user interface elements represents a respective time interval for a note, the plurality of user interface elements includes a first subset of the plurality of user interface elements representing played notes for the corresponding respective time interval and a second subset of the plurality of user interface elements representing rests for the corresponding respective time interval;

the plurality of user interface elements correspond to toggleable buttons arranged in an array comprising a plurality of rows and columns, each toggleable button being activated or inactivated by a user, wherein a row of the plurality of rows corresponds to a sequence of user interface elements;

receiving a user input interacting with a first user interface element of the first subset of the plurality of user interface elements;

in response to the user input interacting with the first user interface element of the first subset of the plurality of user interface elements:

splitting a played note represented by the first user interface element into two or more played notes;

replacing display of the first user interface element with two or more additional user interface elements, each of the two or more additional user interface elements representing a respective one of the two or more played notes; and providing the audio composition for playback by a speaker.

* * * * *